US010412502B2

(12) United States Patent
Ishii et al.

(10) Patent No.: US 10,412,502 B2
(45) Date of Patent: Sep. 10, 2019

(54) ELECTROACOUSTIC TRANSDUCER WITH DUAL VIBRATION PLATE

(71) Applicant: TAIYO YUDEN CO., LTD., Chuo-ku, Tokyo (JP)

(72) Inventors: Shigeo Ishii, Takasaki (JP); Takashi Tomita, Takasaki (JP); Hiroshi Hamada, Takasaki (JP); Yutaka Doshida, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 0 days.

(21) Appl. No.: 15/641,860

(22) Filed: Jul. 5, 2017

(65) Prior Publication Data

US 2018/0020293 A1 Jan. 18, 2018

(30) Foreign Application Priority Data

Jul. 13, 2016 (JP) ..... 2016-138646
Aug. 29, 2016 (JP) ..... 2016-166589

(51) Int. Cl.

| | |
|---|---|
| ***H04R 17/00*** | (2006.01) |
| ***H04R 1/28*** | (2006.01) |
| ***H04R 7/04*** | (2006.01) |
| ***H04R 7/18*** | (2006.01) |

(52) U.S. Cl.

CPC ..... *H04R 17/00* (2013.01); *H04R 1/2857* (2013.01); *H04R 7/04* (2013.01); *H04R 7/18* (2013.01)

(58) Field of Classification Search

CPC .... H04R 17/025; H04R 17/00; H04R 17/005; H04R 9/02; H04R 1/2857; H04R 7/04; H01L 41/0805; H01L 41/082; H01L 41/04; H01L 41/042; H01L 41/08

See application file for complete search history.

(56) References Cited

U.S. PATENT DOCUMENTS 5,430,803 A * 7/1995 Kimura ..... H04R 1/1016 381/190
2007/0189560 A1* 8/2007 Uenishi ..... H04R 17/00 381/191
2016/0277823 A1* 9/2016 Huang ..... H04R 1/1016

FOREIGN PATENT DOCUMENTS

JP S6268400 A 3/1987
JP 2013150305 A 8/2013
JP 2016111666 6/2016
KR 101439935 B1 * 9/2014

(Continued)

OTHER PUBLICATIONS

A Notification of Reason for Refusal issued by Korean Intellectual Property Office, dated Feb. 20, 2018, for Korean counterpart application No. 1020170089063.

(Continued)

*Primary Examiner* — Fan S Tsang
*Assistant Examiner* — Angelica M McKinney
(74) *Attorney, Agent, or Firm* — Law Office of Katsuhiro Arai

(57) ABSTRACT

An electroacoustic transducer that can improve acoustic characteristics has a housing and a piezoelectric speaker. The piezoelectric speaker has a first vibration plate with a periphery part supported directly or indirectly on the housing, as well as a piezoelectric element placed at least on one side of the first vibration plate, and is constituted in such a way that its rigidity is asymmetric with respect to the center axis of the first vibration plate.

7 Claims, 12 Drawing Sheets

(56) References Cited

FOREIGN PATENT DOCUMENTS

| | | | | |
|---|---|---|---|---|
| KR | 101439935 | B1 | 9/2014 | |
| KR | 101515815 | B1 * | 5/2015 | ..... H04R 9/02 |
| KR | 101515815 | B1 | 5/2015 | |
| KR | 101576134 | B1 * | 12/2015 | |

OTHER PUBLICATIONS

A Notification of Reason for Refusal issued by Korean Intellectual Property Office, dated Aug. 14, 2018, for Korean counterpart application No. 1020170089063.
A Notification of Reason for Refusal issued by Korean Intellectual Property Office, dated Feb. 20, 2019, for Korean counterpart application No. 1020170089063. (2 pages).

* cited by examiner

FIG. 4
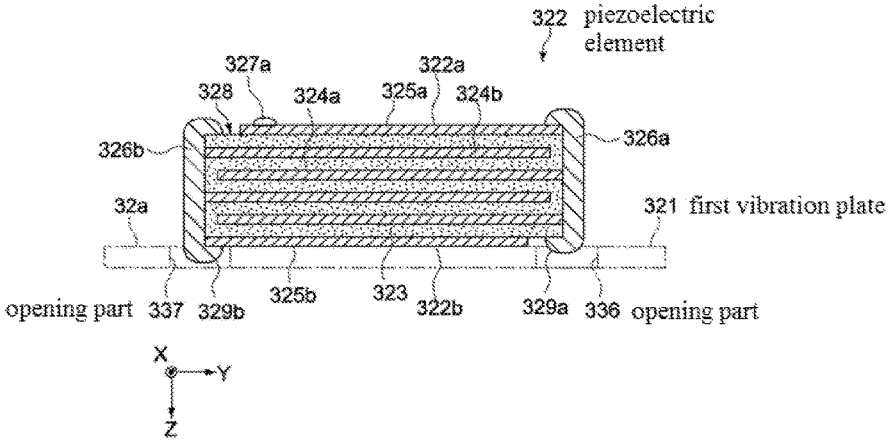
FIG. 5A
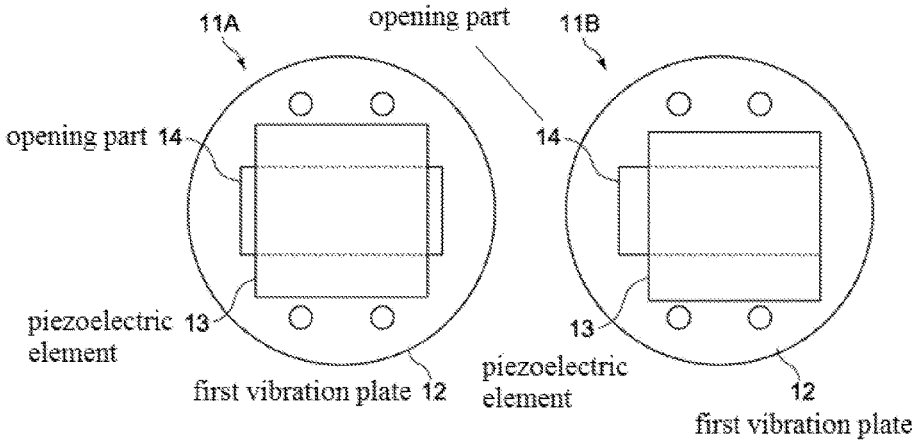
FIG. 5B (h and d are indicated in FIG. 16 electroacoustic transducer)

(h and d are indicated in FIG. 16 electroacoustic transducer)

ELECTROACOUSTIC TRANSDUCER WITH DUAL VIBRATION PLATE

BACKGROUND

Field of the Invention

The present invention relates to an electroacoustic transducer that can be applied to earphones, headphones, mobile information terminals, or the like, for example.

Description of the Related Art

Piezoelectric sound-generating elements are widely used as a means for simple electroacoustic conversion; for example, they are frequently used in acoustic devices such as earphones and headphones, as well as speakers for mobile information terminals, etc. Piezoelectric sound-generating elements are typically constituted by a vibration plate having a piezoelectric element attached to one side or both sides (refer to Patent Literature 1, for example).

On the other hand, Patent Literature 2 describes headphones equipped with a dynamic driver and a piezoelectric driver, wherein, these two drivers are driven in parallel to allow for playback over a wide bandwidth. The piezoelectric driver is provided at the center of the inner face of the front cover that blocks the front face of the dynamic driver and functions as a vibration plate, so that, based on this constitution, the piezoelectric driver functions as a high-frequency range driver.

BACKGROUND ART LITERATURES

[Patent Literature 1] Japanese Patent Laid-open No. 2013-150305

[Patent Literature 2] Japanese Utility Model Laid-open No. Sho 62-68400

SUMMARY

In recent years, acoustic devices, such as earphones and headphones, for example, are facing a need for further improvement of sound quality. In the case of piezoelectric sound-generating elements, therefore, improving the characteristics of their electroacoustic conversion function is considered crucial. It is also desired that, when they are combined with dynamic speakers, these elements achieve higher sound pressures in the high-frequency range.

In light of the aforementioned situations, an object of the present invention is to provide an electroacoustic transducer that can improve acoustic characteristics.

Any discussion of problems and solutions involved in the related art has been included in this disclosure solely for the purposes of providing a context for the present invention, and should not be taken as an admission that any or all of the discussion were known at the time the invention was made.

To achieve the aforementioned object, an electroacoustic transducer pertaining to an embodiment of the present invention has a housing and a piezoelectric speaker.

The piezoelectric speaker has a first vibration plate with a periphery part supported directly or indirectly on the housing, as well as a piezoelectric element placed at least on one side of the first vibration plate, and is constituted in such a way that its rigidity is asymmetric with respect to the center axis of the first vibration plate.

With the aforementioned electroacoustic transducer, the piezoelectric speaker is structured in such a way that its rigidity is asymmetric with respect to the center axis of the first vibration plate, and accordingly the vibration mode of the first vibration plate becomes non-uniform in-plane. This way, the sound pressure levels in the high-frequency range broaden and the sound pressure characteristics improve, and audio playback at good sound quality becomes possible as a result.

The piezoelectric element may be placed at an eccentric position with respect to the first vibration plate.

This way, the vibration mode of the first vibration plate can be made asymmetric with respect to the center axis.

The piezoelectric speaker may further have a passage that penetrates through the first vibration plate in the thickness direction.

The passage may have at least one opening part provided in-plane in the first vibration plate, or it may include at least one cutout part provided along the aforementioned periphery part.

The electroacoustic transducer may further have a dynamic speaker that includes a second vibration body. In this case, the housing has a first space part and a second space part.

The first space part is where the dynamic speaker is placed. The second space part connects to the first space part via the passage, and has a sound-guiding path that guides the sound waves generated by the piezoelectric speaker and dynamic speaker, to the outside.

The passage may include multiple passages. In this case, the sound-guiding path is provided at a position facing the passage having the largest opening area, among the multiple passages. This way, the sound waves generated by the dynamic speaker can be efficiently guided to the sound-guiding path, and consequently the acoustic characteristics of the dynamic speaker can be improved.

The planar shape of the first vibration plate and that of the piezoelectric element are not limited in any way, but typically the planar shape of the first vibration plate is a circle, while the planar shape of the piezoelectric element is a rectangle.

The piezoelectric speaker may further have an annular member. The annular member is fixed to the housing and supports the periphery part of the first vibration plate.

This way, the ease of assembling the piezoelectric speaker with respect to the housing improves, while adjusting the distance between the first vibration plate and the second vibration plate becomes easy.

The distance between the first vibration plate and the second vibration plate is not limited in any way, and can be set in any way as deemed appropriate according to the size of each vibration plate, target acoustic characteristics, etc. For example, the ratio, to the diameter of the second vibration plate, of the distance between the first vibration plate and the second vibration plate, can be set to 0.152 or more but no more than 0.212. This way, the dip in sound pressure characteristics near 8 kHz can be improved.

The first vibration plate may be placed at an eccentric position with respect to the second vibration plate. Acoustic characteristics can also be improved based on this configuration.

As described above, acoustic characteristics can be improved based on the present invention.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

FIG. 4 is a rough cross-sectional side view of the piezoelectric element in the piezoelectric speaker.

FIGS. 5A and 5B are rough plan views explaining two piezoelectric speakers, each having a different constitution.

DESCRIPTION OF THE SYMBOLS

Figure 1:
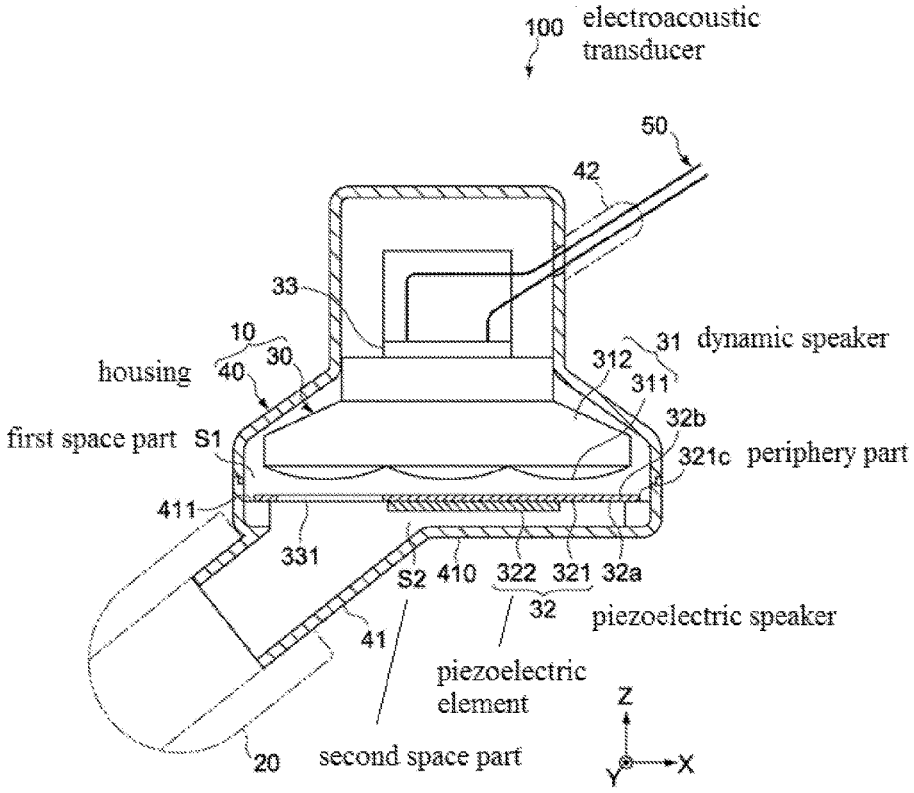
FIG. 1 is a rough cross-sectional side view showing the electroacoustic transducer pertaining to an embodiment of the present invention.

10 - - - Earphone body
20 - - - Earpiece
30 - - - Sounding unit
31, 360 - - - Dynamic speaker
32, 350, 500, 600, 700, 710, 800, 810 - - - Piezoelectric speaker
40, 340 - - - Housing
321, 351, 521, 621, 721, 821 - - - Vibration plate (first vibration plate)
322, 352 - - - Piezoelectric element
331 to 337, 354, 355, 526, 527, 528, 722 - - - Opening part
522 to 525, 622 to 626 - - - Cutout part
100, 300 - - - Earphone (electroacoustic transducer)
E1, 361 - - - Vibration plate (second vibration plate)

DETAILED DESCRIPTION OF EMBODIMENTS

Embodiments of the present invention are explained below by referring to the drawings.

<First Embodiment>

FIG. 1 is a rough cross-sectional side view showing the constitution of an earphone 100 representing the electroacoustic transducer pertaining to an embodiment of the present invention.

In the figure, the X-axis, Y-axis and Z-axis represent directions of three axes that are orthogonal to each other.

[General Constitution of Earphone]

An earphone 100 has an earphone body 10 and an earpiece 20. The earpiece 20 is attached to a sound-guiding path 41 of the earphone body 10, and constituted in such a way that it can be worn on the user's ear.

The earphone body 10 has a sounding unit 30 and a housing 40 that encloses the sounding unit 30. The sounding unit 30 has a dynamic speaker 31 and a piezoelectric speaker 32.

[Housing]

The housing 40 has an interior space in which the sounding unit 30 is enclosed, and is constituted in a two-part splitting structure that allows for separation in the Z-axis direction. Provided at a bottom part 410 of the housing 40 is a sound-guiding path 41 that guides the sound waves generated by the sounding unit 30, to the outside.

The housing 40 has a support part 411 that supports the periphery part of the piezoelectric speaker 32. The support part 411 is formed in an annular shape, and is provided in a manner projecting upward from the periphery part of the bottom part 410. In the figure, the top face of the support part 411 is formed as a plane running in parallel with the XY plane, and supports the periphery part of the piezoelectric speaker 32 as described below, either directly or indirectly via other member.

The interior space of the housing 40 is divided by the piezoelectric speaker 32 into a first space part S1 and a second space part S2. The first space part S1 is where the dynamic speaker 31 is placed. The second space part S2 is a space part that connects to the sound-guiding path 41, and formed between the piezoelectric speaker 32 and the bottom part 410 of the housing 40. The first space part S1 and second space part S2 are connected to each other via opening parts 331 to 337 in the piezoelectric speaker 32 (refer to FIG. 3).

[Dynamic Speaker]

The dynamic speaker 31 is constituted by a dynamic speaker unit that functions as a woofer designed for audio playback in the low-frequency range. In this embodiment, for example, it is constituted by a dynamic speaker that primarily generates sound waves of 7 kHz or lower, and has a mechanism part 311 that includes a voice coil motor (electromagnetic coil) or other vibration body, as well as a pedestal part 312 that supports the mechanism part 311 in a manner allowing it to vibrate.

Figure 2:
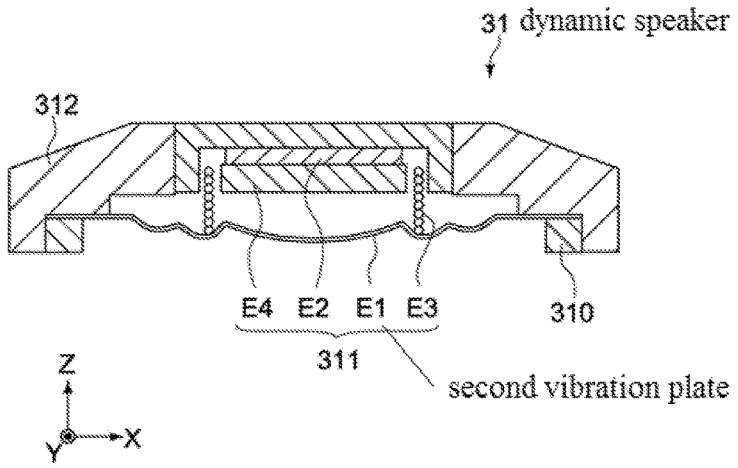
FIG. 2 is a rough cross-sectional side view showing the dynamic speaker in the electroacoustic transducer.

The constitution of the mechanism part 311 of the dynamic speaker 31 is not limited in any way. FIG. 2 is a cross-sectional view of key areas, showing a constitutional example of the mechanism part 311. The mechanism part 311 has a vibration plate E1 (second vibration plate) supported on the pedestal part 312 in a vibrable manner, a permanent magnet E2, a voice coil E3, and a yoke E4 that supports the permanent magnet E2. The vibration plate E1 is supported on the pedestal part 312 as a result of its periphery part being sandwiched between the bottom part of the pedestal part 312 and an annular fixing jig 310 assembled integrally thereon.

The voice coil E3 is formed by winding a conductive wire around a bobbin that serves as a winding core, and is joined to the center part of the vibration plate E1. Also, the voice coil E3 is placed vertically to the direction of the magnetic flux of the permanent magnet E2. When alternating current (audio signal) is supplied to the voice coil E3, electromagnetic force acts upon the voice coil E3 and consequently the voice coil E3 vibrates in the Z-axis direction in the figure according to the signal waveform. This vibration is transmitted to the vibration plate E1 which is coupled to the voice coil E3, and causes the air in the first space part S1 (FIG. 1) to vibrate, thereby generating a sound wave in the aforementioned low-frequency range.

The dynamic speaker 31 is fixed inside the housing 40 using any method as deemed appropriate. On top of the dynamic speaker 31, a circuit board 33 that constitutes the electrical circuit of the sounding unit 30 is fixed. The circuit board 33 is electrically connected to a cable 50 that has been introduced via a lead part 42 of the housing 40, and outputs electrical signals to the dynamic speaker 31, and also to the piezoelectric speaker 32, via wire members that are not illustrated.

[Piezoelectric Speaker]

The piezoelectric speaker 32 constitutes a speaker unit that functions as a tweeter designed for audio playback in the high-frequency range. In this embodiment, the oscillation frequency of the piezoelectric speaker 32 is set in such a way that sound waves of 7 kHz or higher are primarily generated, for example. The piezoelectric speaker 32 has a vibration plate 321 (first vibration plate) and a piezoelectric element 322.

The vibration plate 321 is constituted by a metal (such as 42 alloy) or other conducive material, or resin (such as liquid crystal polymer) or other insulating material, and its planar shape is formed as circle. The outer diameter and thickness of the vibration plate 321 are not limited in any way, and may be set in any way as deemed appropriate according to the size of the housing 40, frequency band of playback sound waves, and so on. In this embodiment, a vibration plate of approx. 8 to 12 mm in diameter and approx. 0.2 mm in thickness is used.

The vibration plate 321 has a first principal face 32*a* facing the sound-guiding path 41, and a second principal face 32*b* facing the dynamic speaker 31. In this embodiment, the piezoelectric speaker 32 has a unimorph structure, whereby the piezoelectric element 322 is joined only to the first principal face 32*a* of the vibration plate 321.

It should be noted that the piezoelectric speaker 32 is not limited to the foregoing and the piezoelectric element 322 may be joined to the second principal face 32*b* of the vibration plate 321. Also, the piezoelectric speaker 32 may be constituted in a bimorph structure, whereby a piezoelectric element is joined to both principal faces 32*a*, 32*b* of the vibration plate 321, respectively.

The vibration plate 321 has a periphery part 321*c* supported by the support part 411 of the housing 40. The periphery part 321*c* is elastically supported by the support part 411 via a viscous material layer. Preferably the viscous material layer has appropriate elasticity. This way, the vibration plate 321 is elastically supported by the support part 411, and therefore any resonance variability in the vibration plate 321 is suppressed and stable resonance operation of the vibration plate 321 is ensured as a result.

It should be noted that the vibration plate 321 may be fixed to the support part 411 via an annular member that supports its periphery part 321*c*. Preferably the annular member is constituted by rubber, resin or other material having elasticity because, this way, actions and effects similar to those described above can be obtained. Alternately, the annular member may be constituted by a material of relatively high rigidity, while at the same time it may also be joined to the support part 411 via the viscous material layer.

Figure 3:
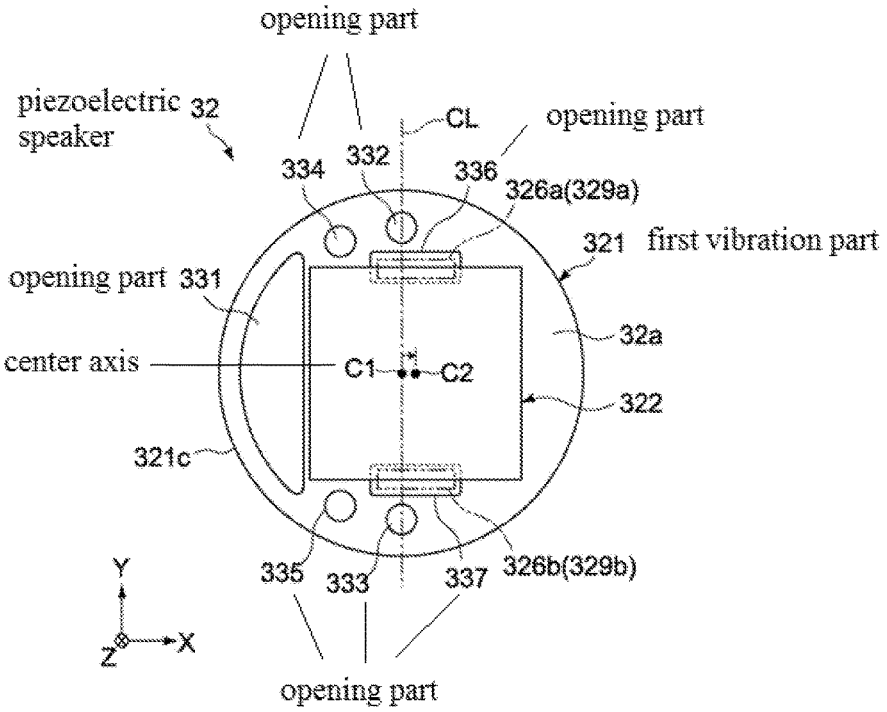
FIG. 3 is a rough bottom view showing the piezoelectric speaker in the electroacoustic transducer.

FIG. 3 is a plan view (or bottom view) of the piezoelectric speaker 32. As shown in this figure, the piezoelectric speaker 32 is constituted in such a way that its rigidity (structural rigidity) is asymmetric (three-dimensionally rotationally asymmetric) with respect to the center axis C1 of the vibration plate 321 (axis running in parallel with the Z-axis direction, through the center of the vibration plate 321).

Here, "its rigidity is asymmetric with respect to the center axis C1" means that its structure, shape, and/or physical property, or the like, are/is asymmetric with respect to the center axis C1, in particular, to the extent that the vibration mode in which the vibration plate 321 oscillates is substantially asymmetric with respect to the center axis C1 (e.g., resulting in detectable differences in resonance frequency (natural vibration number)).

In this embodiment, the planar shape of the piezoelectric element 322 is a rectangle, and the center axis C2 of the piezoelectric element 322 (axis running in parallel with the Z-axis, through the center of the piezoelectric element 322) is displaced in the X-axis direction, by a specified amount, from the center axis C1 of the vibration plate 321. In other words, the piezoelectric element 322 is placed at an eccentric position with respect to the vibration plate 321. This way, the vibration center of the vibration plate 321 shifts to a position different from the center axis C1, and consequently the vibration mode of the piezoelectric speaker 32 becomes asymmetric with respect to the center axis C1.

Furthermore, as shown in FIG. 3, the vibration plate 321 is anisotropic, having different shapes (modes) in the area corresponding to its right half, and the area corresponding to its left half, across the center line CL (line running in parallel with the Y-axis direction, through the center of the vibration plate 321). In other words, the piezoelectric speaker 32 is constituted so that it becomes asymmetric with respect to the center line CL, because it has multiple opening parts 331 to 337 (passages) that penetrate through the vibration plate 321 in the thickness direction, and because the respective opening parts 331 to 337 are formed in the mode described below.

The opening part 331 is formed roughly in a semi-circular or crescent shape in the area between the periphery part 321*c* of the vibration plate 321 and one side part of the piezoelectric element 322, and it has the largest opening area among the opening parts 331 to 337. The piezoelectric speaker 32 is assembled on the support part 411 in such a way that the opening part 331 faces the inlet of the sound-guiding path 41 (refer to FIG. 1).

The opening parts 332 to 335 are each constituted as a circular hole provided in the area between the periphery part

321*c* and the piezoelectric element 322. Among them, the opening parts 332, 333 are provided on the center line CL at symmetric positions with respect to the center axis C1, respectively, while the opening parts 334, 335 are provided between the opening part 331 and the opening parts 332, 333, respectively. The opening parts 332 to 335 are formed as round holes, each having the same diameter (such as a diameter of approx. 1 mm); however, it goes without saying that their shape is not limited to the foregoing.

On the other hand, the opening parts 336, 337 are provided between the opening parts 332, 333 and the piezoelectric element 322, respectively, and each formed in the shape of a rectangle having long sides in the X-axis direction. The opening parts 336, 337 are formed along the periphery part of the piezoelectric element 322, and some areas thereof are partially covered by the periphery part of the piezoelectric element 322. The opening parts 336, 337 not only function as passages that penetrate through the vibration plate 321 from top to bottom, but they also function to prevent the two external electrodes of the piezoelectric element 322 from shorting with each other, as described later.

FIG. 4 is a rough cross-sectional side view showing the interior structure of the piezoelectric element 322.

The piezoelectric element 322 has an element body 328, as well as a first external electrode 326*a* and a second external electrode 326*b*, which are facing each other in the Y-axis direction. In addition, the piezoelectric element 322 has a first principal face 322*a* and a second principal face 322*b*, which are facing each other and running vertical to the Z-axis. The second principal face 322*b* of the piezoelectric element 322 is constituted as a mounting surface facing the first principal face 32*a* of the vibration plate 321.

The element body 328 has a structure whereby ceramic sheets 323 and internal electrode layers 324*a*, 324*b* are stacked in the Z-axis direction. To be specific, the internal electrode layers 324*a*, 324*b* are stacked alternately by sandwiching a ceramic sheet 323 in between. The ceramic sheets 323 are formed by lead zirconate titanate (PZT), niobium oxide containing alkali metal, or other piezoelectric material, for example. The internal electrode layers 324*a*, 324*b* are formed by any various metal materials and other conductive materials.

The first internal electrode layers 324*a* of the element body 328 are connected to the first external electrode 326*a*, while at the same time insulated from the second external electrode 326*b* by the margin parts of the ceramic sheets 323. Also, the second internal electrode layers 324*b* of the element body 328 are connected to the second external electrode 326*b*, while at the same time insulated from the first external electrode 326*a* by the margin parts of the ceramic sheets 323.

In FIG. 4, the topmost layer among the first internal electrode layers 324*a* constitutes a first leader electrode layer 325*a* that partially covers the top side (top face in FIG. 4) of the element body 328, while the bottommost layer among the second internal electrode layers 324*b* constitutes a second leader electrode layer 325*b* that partially covers the bottom side (bottom face in FIG. 4) of the element body 328. The first leader electrode layer 325*a* has a terminal part 327*a* of one polarity which is electrically connected to the circuit board 33 (FIG. 1), while the second leader electrode layer 325*b* is electrically and mechanically connected to the first principal face 32*a* of the vibration plate 321 by means of any appropriate joining material. If the vibration plate 321 is constituted by a conductive material, the joining material used may be any conductive adhesive, solder or other conductive joining material, in which case a terminal part of the other polarity may be provided on the vibration plate 321.

The first and second external electrodes 326*a*, 326*b* are formed by any of the various metal materials or other conductive materials at roughly the center parts on both end faces of the element body 328 in the Y-axis direction, respectively. The first external electrode 326*a* is electrically connected to the first internal electrode layers 324*a* and the first leader electrode layer 325*a*, while the second external electrode 326*b* is electrically connected to the second internal electrode layers 324*b* and the second leader electrode layer 325*b*.

This constitution allows each ceramic sheet 323 between each pair of internal electrode layers 324*a*, 324*b* to expand and contract at a specified frequency when alternating-current voltage is applied between the external electrodes 326*a*, 326*b*. This way, the piezoelectric element 322 can generate the vibration to be given to the vibration plate 321.

Now, as shown in FIG. 4, the first and second external electrodes 326*a*, 326*b* project from the both end faces of the element body 328, respectively. Here, raised parts 329*a*, 329*b* projecting toward the first principal face 32*a* of the vibration plate 321 may be formed on the first and second external electrodes 326*a*, 326*b*. Accordingly, the aforementioned opening parts 336, 337 are each formed in a size that encloses the raised part 329*a* or 329*b* as applicable. This prevents the external electrodes 326*a*, 326*b* from electrically shorting with each other as a result of the raised parts 329*a*, 329*b* contacting the vibration plate 321.

[Operation of Earphone]

Next, a typical operation of the earphone 100 in this embodiment, being constituted as above, is explained.

With the earphone 100 in this embodiment, playback signals are input to the circuit board 33 of the sounding unit 30 via the cable 50. Playback signals are input to the dynamic speaker 31, and also to the piezoelectric speaker 32, via the circuit board 33. This way, the dynamic speaker 31 is driven to primarily generate sound waves of 7 kHz or lower in the low-frequency range. At the piezoelectric speaker 32, on the other hand, the vibration plate 321 vibrates due to the expanding and contracting action of the piezoelectric element 322, to primarily generate sound waves of 7 kHz or higher in the high-frequency range. The generated sound waves in the respective bands are transmitted to the user's ear via the sound-guiding path 41. As described above, the earphone 100 functions as a hybrid speaker having a sound generation body for the low-frequency range and a sound generation body for the high-frequency range.

On the other hand, the sound waves generated by the dynamic speaker 31 are formed as composite waves having a sound wave component that vibrates the vibration plate 321 of the piezoelectric speaker 32 and propagates to the second space part S2, as well as a sound wave component that propagates to the second space part S2 via the opening parts 331 to 337. This means that, by optimizing the sizes and number of the opening parts 331 to 337, and the like, the sound waves in the low-frequency range that have been output from the piezoelectric speaker 32 can be adjusted or tuned to frequency characteristics having sound pressure peaks in a specified low-frequency range, for example.

In this embodiment, the piezoelectric speaker 32 is constituted in such a way that its rigidity is asymmetric with respect to the center axis C1. To be specific, the piezoelectric element 322 is placed at an eccentric position with respect to the vibration plate 321, and the shapes and number of the opening parts 331 to 337 are constituted in a manner asymmetric with respect to the Y-axis direction of the vibration plate 321 (refer to FIG. 3). As a result, the vibration mode of the vibration plate 321 becomes non-uniform in-plane. This way, the sound pressure levels in the high-frequency range broaden and the sound pressure characteristics improve, and audio playback at good sound quality becomes possible as a result.

Figure 6A:
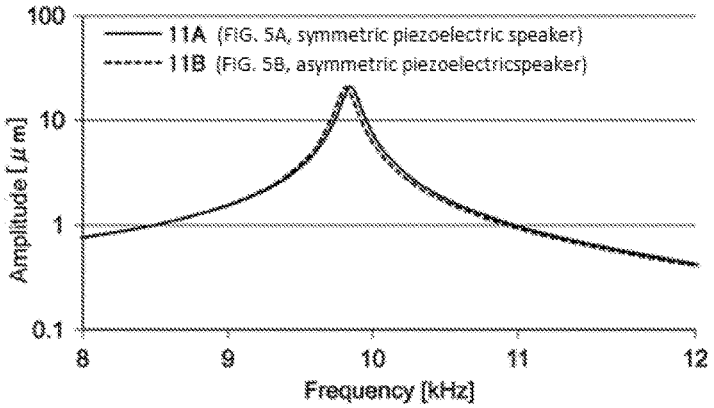
FIGS. 6A and 6B are simulation results showing a comparison of the frequency characteristics of the two piezoelectric speakers.
Figure 6B:
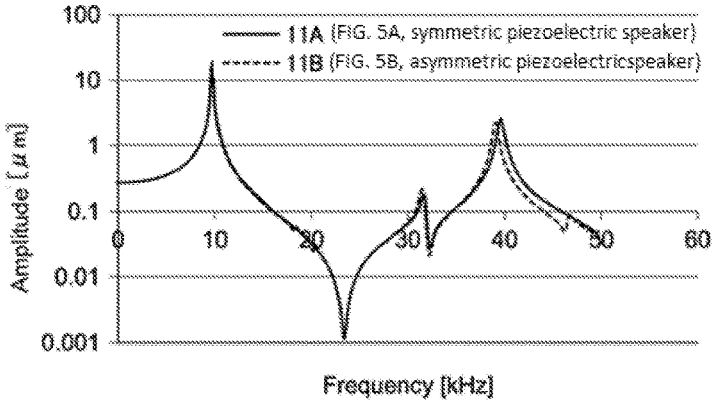

As an example, two sample piezoelectric speakers 11A, 11B shown in FIGS. 5A and 5B were produced, and their frequency characteristics were compared; as a result, the simulation results shown in FIGS. 6A and 6B were obtained.

Here, the samples 11A, 11B both have a circular vibration plate 12 and a rectangular piezoelectric element 13 placed on top; however, the two are different in that, while the piezoelectric element 13 is placed at the center of the vibration plate 12 in the sample 11A, the piezoelectric element 13 is placed at an eccentric position with respect to the vibration plate 12 in the sample 11B. It should be noted that a rectangular opening part 14 wider than the piezoelectric element 13 is provided at the center of the vibration plate 12, and the piezoelectric element 13 is placed at the center of the opening part 14 in the sample 11A, while the piezoelectric element 13 is placed at an eccentric position with respect to the opening part 14 in the sample 11B.

FIG. 6A shows the frequency characteristics of the samples 11A, 11B near their resonance frequencies, while FIG. 6B shows their frequency characteristics in high-order modes. It was confirmed that the resonance frequencies (natural vibration number) of the samples 11A, 11B were not much different, and the resonance frequency of the sample 11B was slightly lower (FIG. 6A). With the sample 11B, which is less symmetric with respect to the center axis of the vibration plate 12 compared to the sample 11A, it is presumed that the resonance frequency dropped because of a combination of reasons including shifting of the maximum amplitude position and drop in the amplitude at the center position. At the higher-order resonance frequencies (such as 30 kHz or higher), however, it was confirmed that the difference between the frequency characteristics of the samples 11A, 11B became clearer (FIG. 6B).

As described above, the less symmetric the piezoelectric speaker 32 with respect to the center axis C1, the more the resonance point drops in the higher-order modes. It is presumed that this trend becomes more prominent as the degree of the aforementioned asymmetry becomes greater. This means that desired high frequency characteristics can be realized by adjusting the asymmetry of the piezoelectric speaker 32 in a desired manner. Also, as the asymmetry of the piezoelectric speaker becomes higher, the resistance elements of vibration increase and the mechanical sharpness (Q factor) of resonance decreases, and the sound quality improves as a result.

Figure 7:
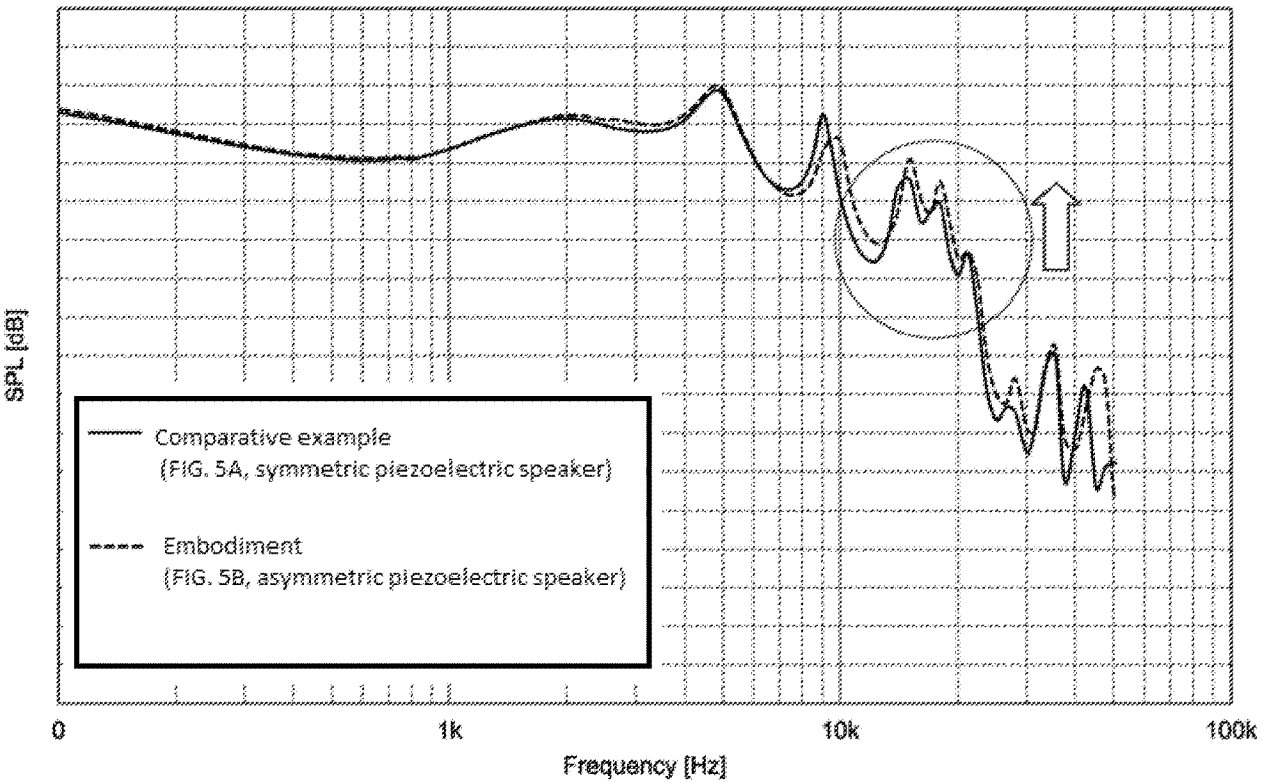
FIG. 7 is experimental results showing the frequency characteristics of the electroacoustic transducer.

On the other hand, it was confirmed that the asymmetry of the piezoelectric speaker 32 would improve the sound pressure level, particularly in the high-frequency range, when the dynamic speaker 31 was used in combination. FIG. 7 provides experimental results showing the frequency characteristics of sounds played back in the earphone 100 in this embodiment. As a comparative example, the frequency characteristics obtained when the piezoelectric speaker (sample 11A) shown in FIG. 5A was set in the housing 40, are shown by the solid line.

According to this embodiment, the sound pressure levels in the high-frequency range of 10 kHz or higher can be raised beyond the levels in the comparative example, as shown in FIG. 7. This is presumably explained by the asymmetry of the piezoelectric speaker 32 in this embodiment, which caused the maximum amplitude position of the vibration plate 321 to be set away from the center of the vibration plate 321, and this mitigated the cancelling out of sound waves in the high-frequency range and improved the sound pressure characteristics as a result. Also, it was confirmed that the sound pressure levels rose in the bands beyond the audible range of 20 kHz or higher, which suggests that playback of deeper sounds is possible.

Additionally, according to this embodiment, the opening part 331 of the piezoelectric speaker 32 is placed in a manner facing the sound-guiding path 41, and therefore the sounds played back by the dynamic speaker 31 can be efficiently guided to the sound-guiding path 41. This improves the sound pressure levels in the low-frequency range (7 kHz or below), as shown in FIG. 7, which makes it possible to improve the sound pressure characteristics over all frequency ranges from low to high.

<Second Embodiment>

FIGS. 8 to 15 are rough plan views (or bottom views) showing the constitutions of the piezoelectric speaker pertaining to the second embodiment of the present invention. The following primarily explains those constitutions that are different from the first embodiment, and other constitutions that are identical to the first embodiment are not explained or are explained in a simplified manner by using the same symbols.

With the piezoelectric speaker in this embodiment, the constitution of the vibration plate is different from that in the first embodiment described above, as shown in each of the constitutional examples explained below. It should be noted that the following explains examples where the piezoelectric element 322 is placed at the center of the vibration plate; however, it goes without saying that this embodiment is not limited to these examples, and the piezoelectric element 322 may be placed at an eccentric position with respect to the vibration plate, as in the first embodiment.

(Constitutional Example 1)

Figure 8:
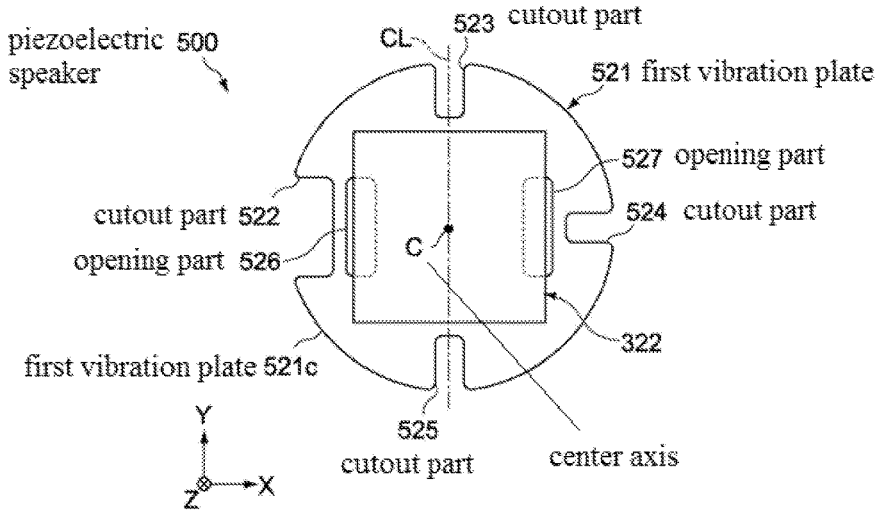
FIG. 8 is a plan view showing a constitutional example of the piezoelectric speaker explained in the second embodiment of the present invention.

A piezoelectric speaker 500 shown in FIG. 8 has multiple (four in this example) cutout parts 522 to 525, which serve as passages, provided in a periphery part 521*c* of a circular vibration plate 521, as well as two opening parts 526, 527 formed in-plane on the vibration plate 521. The opening parts 526, 527 are intended to prevent short-circuiting between the external electrodes of the piezoelectric element 322; however, they also function as sound passage holes (passages).

The cutout parts 522 to 525 are provided at 90° intervals, and each formed at the same depth from the periphery part 521*c* toward the center axis C, where the depth is such that a passage that interconnects the first space part S1 and second space part S2 of the housing 40 can be constituted. Among those, the cutout part 522 is formed with a larger opening width than the other cutout parts 523 to 525, while the other cutout parts 523 to 525 are all formed with the same opening width. In this way, the vibration plate 521 is formed in a laterally asymmetric shape with respect to the center line CL running in parallel with the Y-axis direction.

The piezoelectric speaker 500 of this constitution can achieve operations and effects similar to those in the first embodiment described above, because it has an asymmetric structure with respect to the center axis C1. Furthermore, in FIG. 8, the piezoelectric element 322 can be positioned more eccentric toward the right, for example, with respect to the center line CL, to increase the asymmetry of the piezoelectric speaker 500 further.

It should be noted that, in this example, preferably the piezoelectric speaker 500 is installed in the housing 40 in such a way that the cutout part 522 having the largest area of the passage faces the sound-guiding path 41 (FIG. 1).

(Constitutional Example 2)

Figure 9:
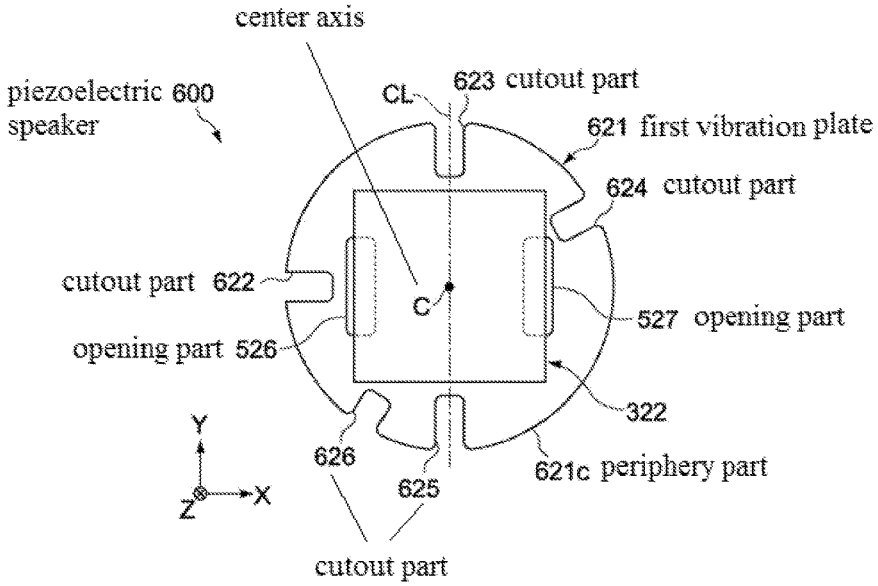
FIG. 9 is a plan view showing another constitutional example of the piezoelectric speaker.

A piezoelectric speaker 600 shown in FIG. 9 has multiple (five in this example) cutout parts 622 to 626, which serve as passages, provided in a periphery part 621*c* of a circular vibration plate 621, as well as the aforementioned opening parts 526, 527.

The cutout parts 622 to 626 are provided at unequal intervals along a circumference of the vibration plate, and each is formed at an arbitrary depth from the periphery part 621*c* toward the center axis C, where the depth is such that a passage that interconnects the first space part S1 and second space part S2 of the housing 40 can be constituted.

In this constitutional example, the number, distribution, etc., of the cutout parts 622 to 625 are set so that they become asymmetric with respect to the center line CL running in parallel with the Y-axis direction. The piezoelectric speaker 600 of this constitution can achieve operations and effects similar to those in the first embodiment described above, because it has an asymmetric structure with respect to the center axis C1. Furthermore, in FIG. 9, the piezoelectric element 322 can be positioned more eccentric toward the right, for example, with respect to the center line CL, to increase the asymmetry of the piezoelectric speaker 600 further.

It should be noted that, in this example, preferably the piezoelectric speaker 600 is installed in the housing 40 in such a way that the locations where the cutout parts 625, 626, 622 representing closely-spaced passages are formed, face the sound-guiding path 41 (FIG. 1).

(Constitutional Example 3)

Figure 10:
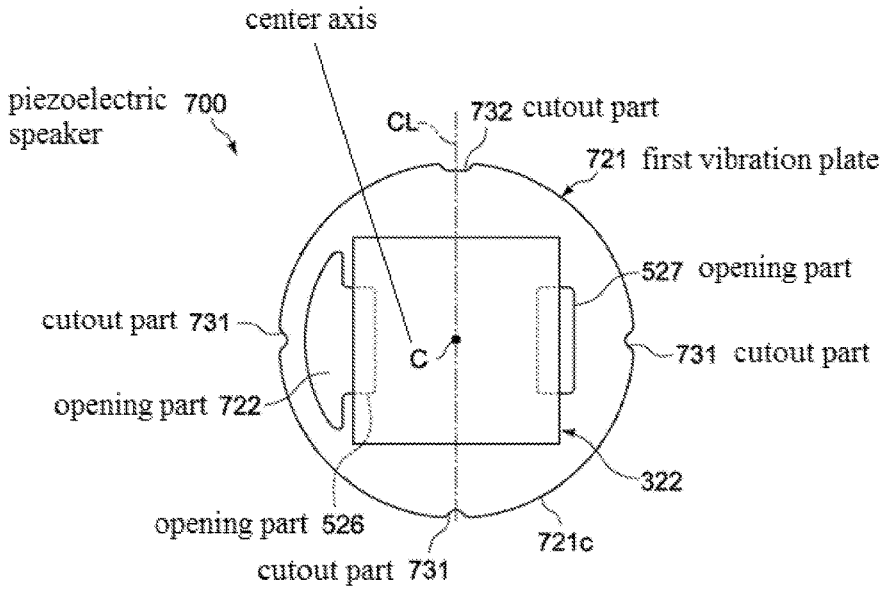
FIG. 10 is a plan view showing another constitutional example of the piezoelectric speaker.

A piezoelectric speaker 700 shown in FIG. 10 has an opening part 722, which serves as a passage, provided in-plane in a circular vibration plate 721, and the opening parts 526, 527 for preventing short-circuiting.

The opening part 722 is formed as a semi-circular or crescent shape similar to the opening part 331 in the first embodiment. In this example, this opening part 722 is formed in a manner continuing to the one opening part 526 for preventing short-circuiting; however, the opening part 722 is not limited to the foregoing, and it may be an opening part independent from the opening part 526.

It should be noted that four concave parts 731, 732 are provided at 90° intervals on a periphery part 721*c* of the vibration plate 721. These concave parts 731, 732 are used for positioning with respect to the support part 411 of the housing 40. In particular, as shown in the figure, one concave part 732 of the four concave parts can be shaped differently from the remaining three concave parts 731 to provide a guideline indicating the directionality of the vibration plate 721, which is advantageous in that its misassembly in the housing 40 can be prevented.

In this constitutional example, the position of the opening part 722 is set asymmetric with respect to the center line CL running in parallel with the Y-axis direction. The piezoelectric speaker 700 of this constitution can achieve operations and effects similar to those in the first embodiment described above, because it has an asymmetric structure with respect to the center axis C1. Furthermore, in FIG. 10, the piezoelectric element 322 can be positioned more eccentric toward the right, for example, with respect to the center line CL, to increase the asymmetry of the piezoelectric speaker 700 further.

It should be noted that, in this example, preferably the piezoelectric speaker 700 is installed in the housing 40 in such a way that the opening part 722 that functions as a passage faces the sound-guiding path 41 (FIG. 1).

(Constitutional Example 4)

Figure 11:
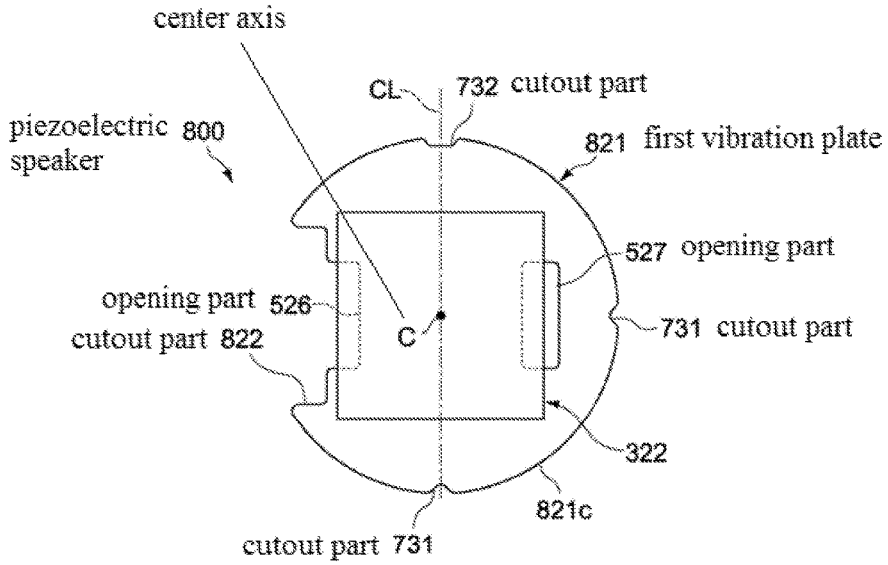
FIG. 11 is a plan view showing another constitutional example of the piezoelectric speaker.

A piezoelectric speaker 800 shown in FIG. 11 has a cutout part 822, which serves as a passage, provided in a periphery part 821*c* of a circular vibration plate 821, and the opening parts 526, 527 for preventing short-circuiting.

In this constitutional example, the cutout part 822 has a shape similar to one formed by cutting out the periphery part 721*c* of the vibration plate 721 adjacent to the arc part of the opening part 722 in Constitutional Example 3. According to this constitution, operations and effects similar to those in Constitutional Example 3 can also be achieved.

Figure 12:
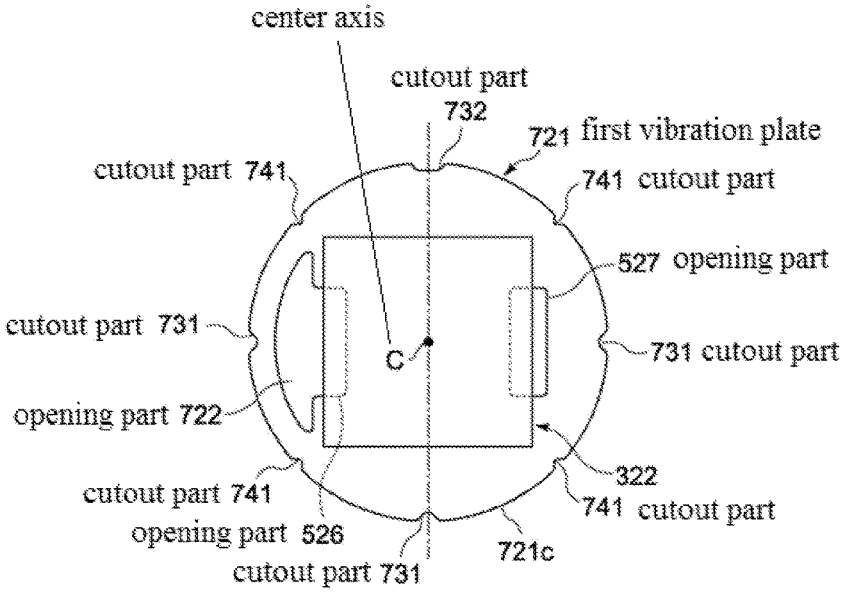
FIG. 12 is a plan view showing a variation example of the constitution in FIG. 10.

It should be noted that, in this embodiment, the concave parts 731, 732 for positioning are provided in the periphery part 721*c* of the vibration plate 721 like in Constitutional Example 3 (FIG. 10), for example; as shown in FIG. 12, however, multiple (four in this example) cutout parts 741 may further be provided in addition to these concave parts 731, 732. The cutout parts 741 are provided, for example, at 90° intervals, in positions offset by 45° from the cutout parts 731, 732 in the circumferential direction, in the periphery part 321*c* of the vibration plate 321. These positions correspond to the positions facing the four corners of the piezoelectric element 322 in the radial direction. This means that, when the piezoelectric element 322 is joined onto the vibration plate 321, the relative positions of the vibration plate 321 and piezoelectric element 322 can be confirmed with reference to these cutout parts 741.

(Constitutional Example 5)

Figure 13:
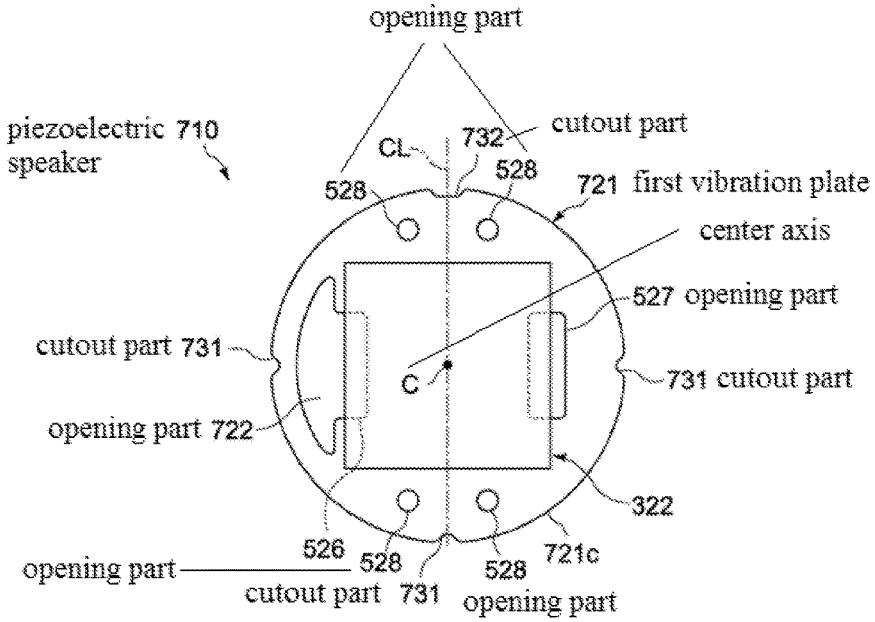
FIG. 13 is a plan view showing a variation example of the constitution in FIG. 10.
Figure 14:
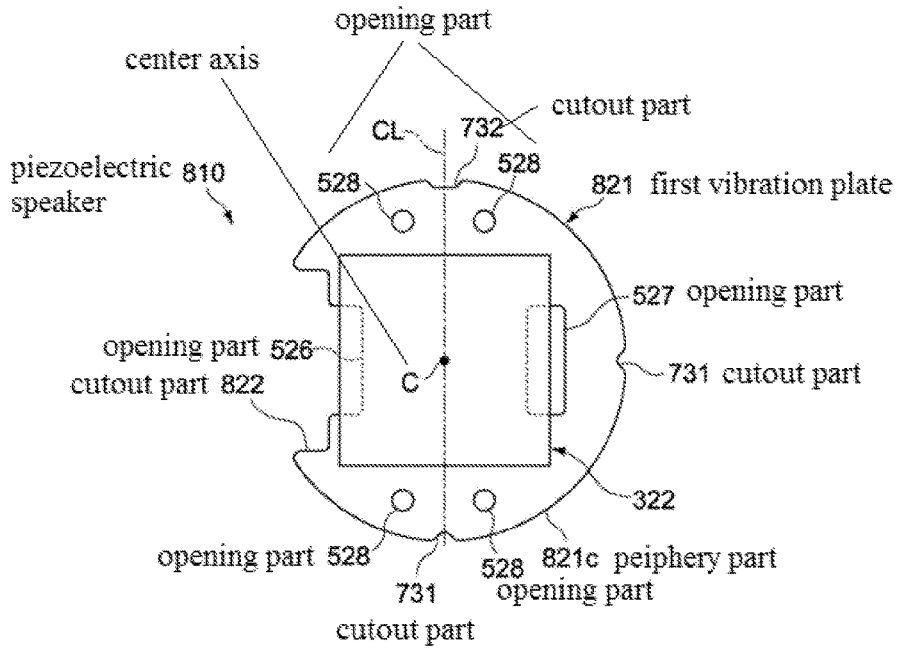
FIG. 14 is a plan view showing a variation example of the constitution in FIG. 11.

With the piezoelectric speakers 700, 800 in Constitutional Example 3 (FIG. 10) and Constitutional Example 4 (FIG. 11), multiple opening parts may further be provided in-plane in the vibration plates 721, 821. FIGS. 13 and 14 show piezoelectric speakers 710, 810 having multiple opening parts 528 in-plane on the vibration plates 721, 821, respectively. The opening parts 528 are circular through-holes that are formed at symmetric positions with respect to the center lines CL of the vibration plates 721, 821, respectively.

The number and size of the opening parts 528 are not limited in any way; in the example illustrated, however, opening parts 528 of approx. 1 mm in diameter are respectively provided at four symmetric positions with respect to the center line CL and piezoelectric element 322. If the vibration plates 721, 821 have a diameter of 12 mm, then the aforementioned four positions are where the distance between the opening parts in a direction orthogonal to the center line CL is 3.2 mm and the distance between the opening parts in a direction parallel with the center line CL is 8.6 mm.

The piezoelectric speakers 700, 800 of this constitution can also achieve effects similar to those in Constitutional Examples 3 and 4. Also, according to this constitutional example, each opening part 528 functions effectively as a passage that lets the sound waves generated from the dynamic speaker pass through, and consequently the sound pressure characteristics of the dynamic speaker in the high-frequency band can be improved, as shown in FIG. 15, for example.

Figure 15:
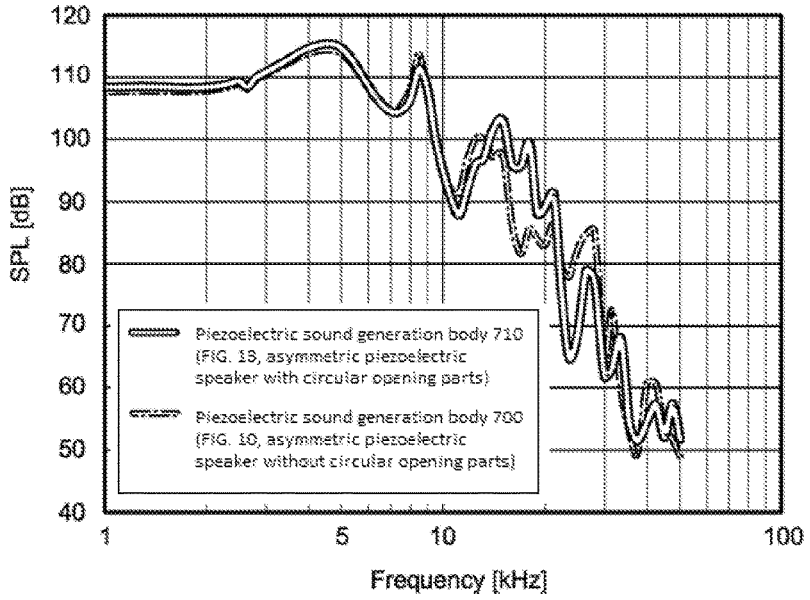
FIG. 15 is experimental results showing a comparison of the frequency characteristics of the dynamic speakers in the electroacoustic transducers having the piezoelectric speaker shown in FIG. 10 and the piezoelectric speaker shown in FIG. 13.

It should be noted that, in FIG. 15, the double, solid line indicates the frequency characteristics of an earphone equipped with the piezoelectric speaker 710 shown in FIG. 13 when only the piezoelectric speaker is driven, while the double, broken line indicates the frequency characteristics of an earphone equipped with the piezoelectric speaker 700 shown in FIG. 10 when only the piezoelectric speaker is driven. As is shown in this figure, the sound pressure characteristics at 10 to 20 kHz can be improved with the piezoelectric speaker 710, compared to the piezoelectric speaker 700.

<Third Embodiment>

Figure 16:
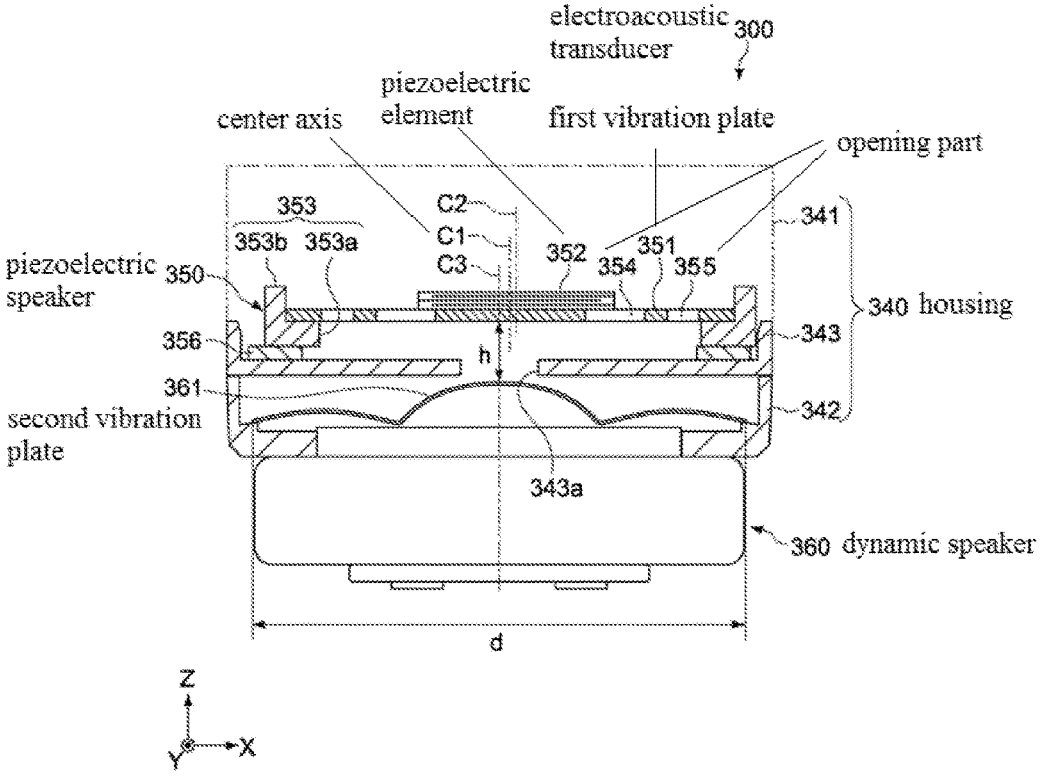
FIG. 16 is a rough cross-sectional side view showing the constitution of the electroacoustic transducer pertaining to the third embodiment of the present invention.

FIG. 16 is a rough cross-sectional side view showing the constitution of the electroacoustic transducer pertaining to the third embodiment of the present invention. The following primarily explains those constitutions that are different from the first embodiment, and other constitutions that are identical to the first embodiment are not explained or explained in a simplified manner by using the same symbols.

An earphone 300 in this embodiment has a housing 340, a piezoelectric speaker 350, and a dynamic speaker 360, as in the first embodiment.

The housing 340 has a first support body 341 with an interior space in which a sound-guiding path (not illustrated) and the piezoelectric speaker 350 are enclosed, a second support body 342 that supports the dynamic speaker 360, and a third support body 343 that joins the first support body 341 and second support body 342 together, to constitute the housing part of the earphone. The third support body 343 has a plate shape with a through-hole 343*a* punctured at the center part, and it is constituted as a protector to prevent a vibration plate 351 of the piezoelectric speaker 350 and a vibration plate 361 of the dynamic speaker 360 from contacting each other. The second support body 342 may be constituted by a part of the dynamic speaker 360.

The piezoelectric speaker 350 has a vibration plate 351 (first vibration plate) and a piezoelectric element 352 and, just like in the first embodiment, is constituted in such a way that its rigidity is asymmetric with respect to the center axis C1 of the vibration plate 351. In other words, the piezoelectric element 352 is placed at an eccentric position with respect to the vibration plate 351 and, in the example illustrated, the center axis C2 of the piezoelectric element 352 is away from the center axis C1 of the vibration plate 351 by a specified distance in the X-axis direction.

In the vibration plate 351, multiple opening parts 354, 355 are provided as passages. One group of opening parts 355 corresponds to the opening parts 332 to 335 (refer to FIG. 3) in the first embodiment, while the other group of opening parts 354 corresponds to the opening parts 336, 337 (refer to FIG. 3) in the first embodiment.

In this embodiment, the piezoelectric speaker 350 further has a mount ring 353 (annular member). The mount ring 353 is fixed to the housing 340 (third support body 343) via a joining layer 356, and supports the periphery part of the vibration plate 351 of the piezoelectric speaker 350. In this embodiment, the mount ring 353 has a pedestal part 353*a* that supports the vibration plate 351 on its top face, and a peripheral wall part 353*b* that positions the periphery part of the vibration plate 351.

The vibration plate 351 supporting structure of the mount ring 353 is not limited in any way, and adhesive, double-sided viscous tape, etc., may be used. Preferably the joining layer 356 is constituted by a viscous material having appropriate elasticity, and this way, the piezoelectric speaker 350 is elastically supported with respect to the housing 340.

Since the piezoelectric speaker 350 has the mount ring 353, the ease of assembling the piezoelectric speaker 350 with respect to the housing 430 improves, while adjusting the position of the piezoelectric speaker 350 relative to the dynamic speaker 360 becomes easy. Typically, the vibration plate 351 is placed concentrically to the vibration plate 361 of the dynamic speaker 360; however, the vibration plate 351 may be placed at an eccentric position with respect to the vibration plate 361.

In this embodiment, the center axis C1 of the vibration plate 351 is placed at a position away from the center axis C3 of the vibration plate 361 by a specified distance in the X-axis direction, as shown in FIG. 16. By placing the piezoelectric speaker 350 asymmetric with respect to the dynamic speaker 360 this way, the acoustic characteristics of the piezoelectric speaker 350 can also be improved. Such constitution can be adopted as deemed appropriate according to the shape and size of the housing 430, position of the sound-guiding path, and so on.

Furthermore, according to this embodiment, the relative distance from the piezoelectric speaker 350 to the dynamic speaker 360 can be set by adjusting the thickness (height) of the pedestal part 353*a* of the mount ring 353, and this makes the adjustment of this distance easy. In addition, by optimizing this distance, the sound pressure characteristics in a specified frequency band can be optimized.

Figure 17:
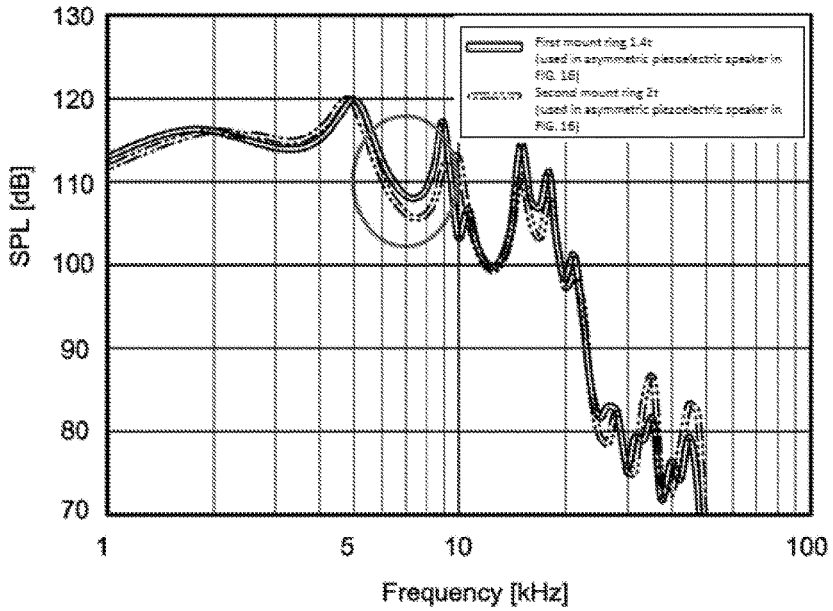
FIG. 17 is experimental results showing the sound pressure characteristics of the electroacoustic transducers.

For example, FIG. 17 shows a comparison of experimental results regarding the frequency characteristics of playback sound with respect to earphones produced according to FIG. 16, each using one of two mount rings 353 with different pedestal part 353*a* thicknesses. In FIG. 17, the double, solid line indicates the sound pressure characteristics obtained when the first mount ring whose pedestal part 353*a* had a thickness of 1.4 times the unit length (t) was applied, while the double, broken line indicates the sound pressure characteristics obtained when the second mount ring whose pedestal part 353*a* had a thickness of twice the unit length (t) was applied. The unit length (t) was 1 mm in this example.

It is evident from FIG. 17 that, according to the electroacoustic transducer to which the first mount ring was applied, the sound pressures in the range of roughly 5 kHz to 9 kHz improved in comparison to the electroacoustic transducer to which the second mount ring was applied. This is probably explained by the relationship where, the smaller the distance between the vibration plate 351 of the piezoelectric speaker 350 and the vibration plate 361 of the dynamic speaker 360, the lower the volume of the space between the two becomes, and consequently the easier it becomes for the sound waves generated in the dynamic speaker 360 to be released to the outside via the piezoelectric speaker 350.

The frequency band in which the sound pressures improve according to the distance between the piezoelectric speaker 350 and dynamic speaker 360, is primarily determined by the size of the diameter (d) across the vibration plate 361 of the dynamic speaker 360. To improve the sound pressures at 6 kHz to 9 kHz, for example, the diameter (d) of the vibration plate 361 is 7.5 mm to 13.5 mm, for example. And, when the distance from the top face of the vibration plate 361 to the bottom face of the vibration plate 351 of the piezoelectric speaker 350 is given by h, then the sound pressures in this specified frequency band improve as the ratio of this distance (h) to the diameter (d) (h/d) becomes smaller.

Figure 18A:
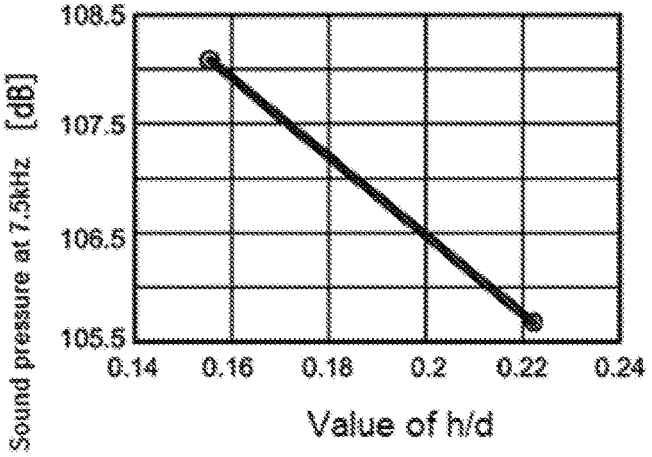
FIGS. 18A and 18B are experimental results showing the relationship between the ratio of the distance between the first and second vibration plates (h) to the diameter of the second vibration plate (d), and the sound pressure in each specified frequency band, of the electroacoustic transducer.
Figure 18B:
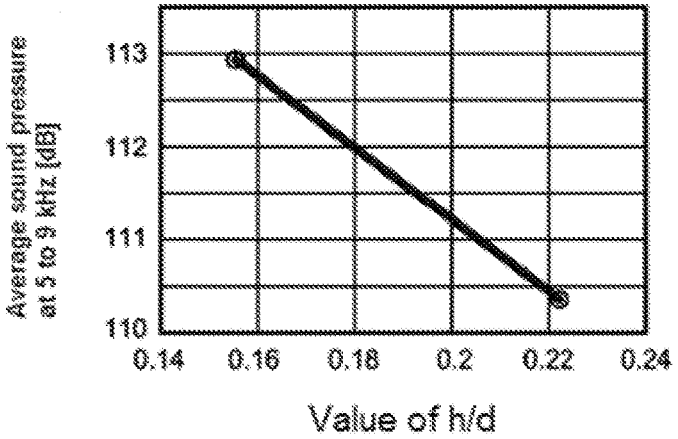

FIGS. 18A and 18B present experimental results showing the relationship between the sound pressure at 7.5 kHz and the value of (h/d), and the relationship between the average sound pressure at 5 to 9 kHz and the value of (h/d), respectively. Here, the value of diameter d was set to 9.2 mm, while the diameter of the vibration plate 351 of the piezoelectric speaker 350 was set to 8 mm, in both. As shown in FIGS. 18A and 18B, the upper limit of the value of (h/d) at which the sound pressures still improve compared to when the second mount ring was applied (double, broken line in FIG. 17), is 0.212 or less (h=1.908 mm or less).

It should be noted that the lower limit of the value of (h/d) is not limited in any way, and it can be set to any value as deemed appropriate so long as the vibration plates 351, 361 do not contact each other (or do not contact the third support body 343). In this example, it was set to the value when the first mount ring was applied (double, solid line in FIG. 17) (0.152 (h=1.368 mm)) or more.

As described above, it is possible, in this embodiment, to improve the dip in sound pressure otherwise observed at 5 kHz to 9 kHz and thereby achieve smooth sound pressure characteristics, by selecting a thickness of the pedestal part 353*a* of the mount ring 353 so as to satisfy "0.152≤(h/d)≤0.212." It should be noted that, although not illustrated, experiments conducted by the inventors of the present invention have confirmed that, by adjusting the value of (h/d), the dip in sound pressure at 5 to 9 kHz can still be improved in the same way as described above, even when the diameter of the vibration plate 351 of the piezoelectric speaker 350 is set to 12 mm.

The foregoing explained embodiments of the present invention; however, the present invention is not limited to the aforementioned embodiments in any way, and it goes without saying that various modifications can be applied.

For example, in the first and second embodiments above, the shape of the vibration plate was made asymmetric with respect to the center axis, or additionally the piezoelectric element was also placed at an eccentric position with respect to the vibration plate, in order to achieve an asymmetric structure of the piezoelectric speaker; however, the present invention is not limited to the foregoing, and operations and effects similar to those described above can also be achieved when only the piezoelectric element is placed at an eccentric position with respect to the vibration plate.

Also, in the above embodiments, the shapes, positions, sizes, and number of the opening parts or cutout parts that constitute the passages of the piezoelectric sounding unit are not limited in any way, and it suffices that there be at least one opening part or cutout part that constitutes a passage.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

The present application claims priority to Japanese Patent Application No. 2016-138646, filed Jul. 13, 2016, and 2016-166589, filed Aug. 29, 2016, each disclosure of which is incorporated herein by reference in its entirety including any and all particular combinations of the features disclosed therein.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. An electroacoustic transducer, comprising:

a housing; and a piezoelectric speaker which has a first vibration plate having a periphery part supported directly or indirectly on the housing, as well as a piezoelectric element placed at least on one side of the first vibration plate, and which is constituted in a manner that the piezoelectric speaker has structural rigidity formed by the first vibration plate and the piezoelectric element, which rigidity is rotationally asymmetric with respect to a center axis of the first vibration plate as viewed in a thickness direction of the first vibration plate, wherein the rotationally asymmetric rigidity is formed by a structure wherein the piezoelectric speaker has a passage that penetrates through the first vibration plate in the thickness direction, wherein the passage includes at least one opening part each defined by a closed periphery provided in-plane in the first vibration plate, wherein open area formed by the at least one opening part is distributed in a manner rotationally asymmetric with respect to the center axis of the first vibration plate as viewed in the thickness direction, wherein the rotational asymmetry is adjusted based on desired high-frequency characteristics of sound and sound pressure characteristics, wherein the electroacoustic transducer further comprises a dynamic speaker that includes a second vibration plate; and the housing has:

a first space part where the dynamic speaker is placed; and a second space part which connects to the first space part via the passage, and which has a sound-guiding path that guides sound waves generated by the piezoelectric speaker and the dynamic speaker, to an outside, wherein when a distance between the first vibration plate and second vibration plate is given by h and a diameter of the second vibration plate is given by d, a relationship "0.152≤(h/d)≤0.212" is satisfied.

2. An electroacoustic transducer according to claim 1, wherein the piezoelectric element is placed at an eccentric position with respect to the first vibration plate.

3. An electroacoustic transducer according to claim 1, wherein the passage further includes at least one cutout part provided in the periphery part.

4. An electroacoustic transducer according to claim 1, wherein:

the passage includes multiple passages; and the sound-guiding path is positioned at a position facing a passage having a largest opening area, among the multiple passages.

5. An electroacoustic transducer according to claim 1, wherein:

a planar shape of the first vibration plate is a circle; and a planar shape of the piezoelectric element is a rectangle.

6. An electroacoustic transducer according to claim 1, wherein the piezoelectric speaker further has an annular member which is fixed to the housing and which supports the periphery part of the first vibration plate.

7. An electroacoustic transducer according to claim 1, wherein the first vibration plate is placed at an eccentric position with respect to the second vibration plate.

* * * * *